US011174874B2

(12) United States Patent
Loveless

(10) Patent No.: US 11,174,874 B2
(45) Date of Patent: Nov. 16, 2021

(54) MULTISTAGE CENTRIFUGAL PUMP WITH COMPRESSION BULKHEADS

(71) Applicant: GE Oil & Gas Esp, Inc., Oklahoma City, OK (US)

(72) Inventor: Colby Lane Loveless, Oklahoma City, OK (US)

(73) Assignee: Baker Hughes ESP, Inc., Houston, TX (US)

( * ) Notice: Subject to any disclaimer, the term of this patent is extended or adjusted under 35 U.S.C. 154(b) by 267 days.

(21) Appl. No.: 15/512,071

(22) PCT Filed: Sep. 17, 2014

(86) PCT No.: PCT/US2014/055995

§ 371 (c)(1),
(2) Date: Mar. 17, 2017

(87) PCT Pub. No.: WO2016/043726

PCT Pub. Date: Mar. 24, 2016

(65) Prior Publication Data

US 2017/0248157 A1 Aug. 31, 2017

(51) Int. Cl.
*F04D 29/42* (2006.01)
*F04D 29/62* (2006.01)
(Continued)

(52) U.S. Cl.
CPC ..... *F04D 29/628* (2013.01); *F04D 1/06* (2013.01); *F04D 13/086* (2013.01); *F04D 13/10* (2013.01);
(Continued)

(58) Field of Classification Search
CPC combination set(s) only.
See application file for complete search history.

(56) References Cited

U.S. PATENT DOCUMENTS 3,238,879 A * 3/1966 Shallenberg ..... F04D 13/10 415/131
6,971,848 B2 * 12/2005 Watson ..... F04D 1/063 415/199.2

(Continued)

FOREIGN PATENT DOCUMENTS

| | | |
|---|---|---|
| EP | 2 366 904 B1 | 3/2014 |
| RU | 2 277 191 C2 | 5/2006 |
| RU | 2 516 353 C1 | 5/2014 |

OTHER PUBLICATIONS

Office Action and Search issued in connection with corresponding RU Application No. 2017108407 dated Mar. 5, 2018.

(Continued)

*Primary Examiner* — Woody A Lee, Jr.
(74) *Attorney, Agent, or Firm* — Crowe & Dunlevy, P.C.

(57) ABSTRACT

A multistage centrifugal pump includes an upstream housing and a downstream housing. The upstream housing and the downstream housing each have a first end, a second end and a plurality of turbomachinery stages. Each of the plurality of turbomachinery stages includes a diffuser and an impeller. A compression bulkhead is connected between the second end of the upstream housing and the first end of the downstream housing. The compression bulkhead applies a compressive force to the diffusers within the upstream housing.

14 Claims, 3 Drawing Sheets

(51) Int. Cl.

| | |
|---|---|
| ***F04D 13/10*** | (2006.01) |
| ***F04D 1/06*** | (2006.01) |
| ***F04D 13/08*** | (2006.01) |
| ***F04D 29/22*** | (2006.01) |
| ***F04D 29/44*** | (2006.01) |

(52) U.S. Cl.
CPC ..... *F04D 29/22* (2013.01); *F04D 29/426* (2013.01); *F04D 29/441* (2013.01)

(56) References Cited

U.S. PATENT DOCUMENTS

| | | | | |
|---|---|---|---|---|
| 7,841,395 | B2 * | 11/2010 | Gay | E21B 43/128 166/105 |
| 2003/0185676 | A1 | 10/2003 | James et al. | |
| 2005/0074331 | A1 | 4/2005 | Watson | |
| 2008/0292454 | A1 | 11/2008 | Brunner et al. | |
| 2013/0017075 | A1 | 1/2013 | Orban et al. | |

OTHER PUBLICATIONS

International Search Report and Written Opinion issued in connection with corresponding PCT Application No. PCT/US2014/055995 dated Jun. 1, 2015.

* cited by examiner

MULTISTAGE CENTRIFUGAL PUMP WITH COMPRESSION BULKHEADS

FIELD OF THE INVENTION

This invention relates generally to the field of submersible pumping systems, and more particularly, but not by way of limitation, to an improved centrifugal pump assembly.

BACKGROUND

Submersible pumping systems are often deployed into wells to recover petroleum fluids from subterranean reservoirs. Typically, a submersible pumping system includes a number of components, including an electric motor coupled to one or more pump assemblies. Production tubing is connected to the pump assemblies to deliver the petroleum fluids from the subterranean reservoir to a storage facility on the surface. The pump assemblies often employ axially and centrifugally oriented multistage turbomachines. Each of the components in a submersible pumping system must be engineered to withstand the inhospitable downhole environment.

Most downhole turbomachines include one or more impeller and diffuser combinations, commonly referred to as "stages." The impellers rotate within adjacent stationary diffusers. A shaft keyed only to the impellers transfers mechanical energy from the motor. During use, the rotating impeller imparts kinetic energy to the fluid. A portion of the kinetic energy is converted to pressure as the fluid passes through the downstream diffuser. To reduce wear and improve efficiency, it is important to prevent the diffusers from spinning within the pump housing.

During manufacture, each diffuser-impeller stage is stacked inside the pump housing. To prevent the diffusers from spinning within the housing, the diffusers are stacked under a compressive load. After the stages have been placed into the housing, the pump head is threaded onto the housing to apply the compressive force to the stack of diffusers. Although each stage is only compressed a small amount, the aggregate compression over the entire length of a large multistage pump may be significant. To accommodate the aggregate compression needed for multistage pumps, a long threaded engagement between the pump head and housing is required. Metal fatigue, temperature variances and mechanical shock can reduce the captured compression and allow diffusers to rotate within the pump housing.

Furthermore, in high pressure applications, the down thrust created by the pump stages may overcome the compressive force applied by the pump head. If this occurs, the compression on the diffusers is reduced or eliminated and the diffusers may spin within the pump housing. Accordingly, there is a need for an improved pump design that overcomes these and other deficiencies in the prior art.

SUMMARY OF THE INVENTION

In preferred embodiments, the present invention includes a multistage centrifugal pump that includes an upstream housing and a downstream housing. The upstream housing and the downstream housing each have a first end, a second end and a plurality of turbomachinery stages. Each of the plurality of turbomachinery stages includes a diffuser and an impeller. A compression bulkhead is connected between the second end of the upstream housing and the first end of the downstream housing. The compression bulkhead applies a compressive force to the diffusers within the upstream housing.

In another aspect, the preferred embodiments include an electric submersible pumping system for use in pumping fluids from a wellbore. The electric submersible pumping system includes a motor and a multistage centrifugal pump driven by the motor. The pump includes a shaft, an upstream housing and a downstream housing. The upstream housing and the downstream housing each have a first end, a second end and a plurality of turbomachinery stages. Each of the plurality of turbomachinery stages includes a diffuser and an impeller. A compression bulkhead is connected between the second end of the upstream housing and the first end of the downstream housing. The compression bulkhead applies a compressive force to the diffusers within the upstream housing.

In yet another aspect, the preferred embodiments include a method for assembling a multistage centrifugal pump. The method includes the steps of threading a first end of an upstream housing onto a pump base, loading a plurality of impellers and diffusers into the upstream housing and threading a first end of a compression bulkhead into a second end of the upstream housing. The method of assembly continues by threading a first end of a downstream housing onto a second end the compression bulkhead, loading a plurality of impellers and diffusers into the downstream housing, and threading a pump head into a second end of the downstream housing.

DETAILED DESCRIPTION OF THE PREFERRED EMBODIMENTS

Figure 1:
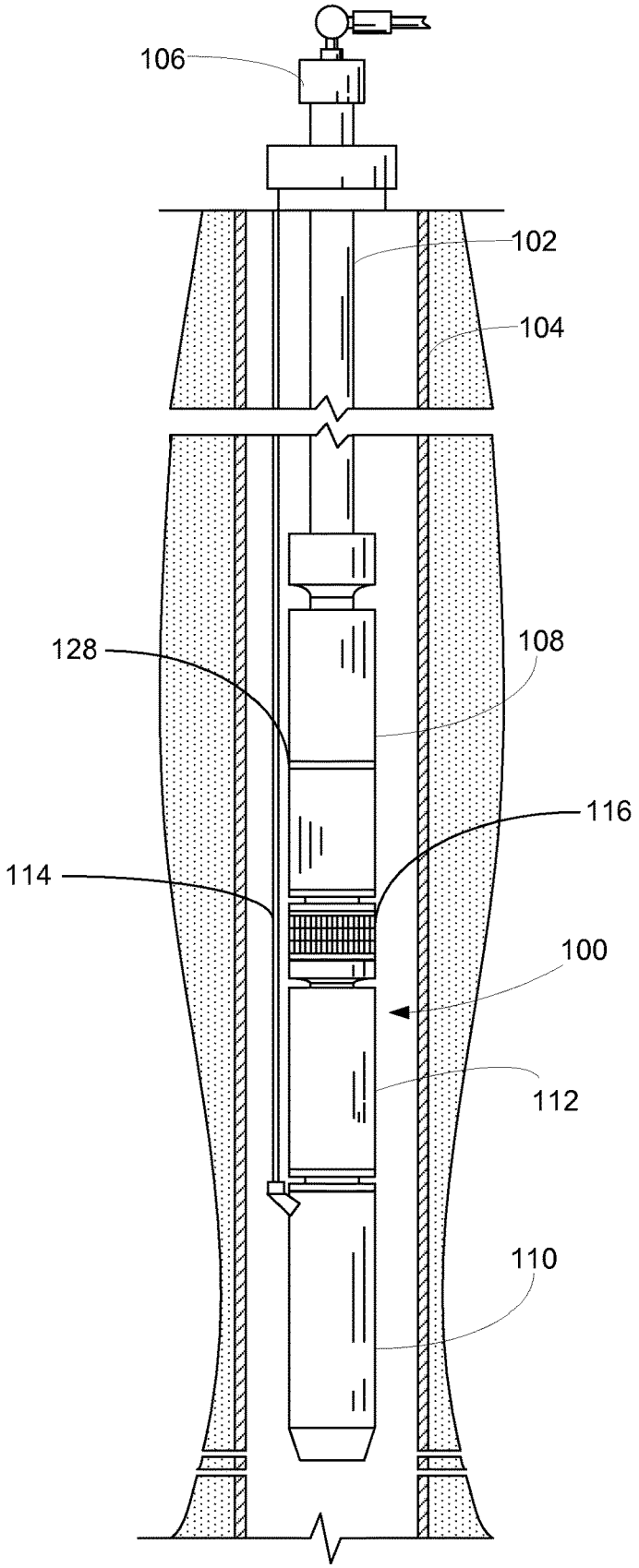
FIG. 1 depicts a submersible pumping system constructed in accordance with a preferred embodiment of the present invention.

In accordance with a first preferred embodiment of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas.

The pumping system 100 preferably includes a pump 108, a motor 110, and a seal section 112. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system are primarily disclosed in a submersible application, some or all of these components can also be used in surface pumping operations.

The motor 110 receives power from a surface-based facility through power cable 114. Generally, the motor 110 is configured to drive the pump 108. In a particularly preferred embodiment, the pump 108 is a turbomachine that uses a plurality impellers and diffusers to convert mechanical energy into pressure head. The pump 108 includes a pump intake 116 that allows fluids from the wellbore 104 to be drawn into the pump 108. The pump 108 forces the wellbore fluids to the surface through the production tubing 102.

In the preferred embodiments, the seal section 112 is positioned above the motor 110 and below the pump 108. The seal section 112 shields the motor 110 from mechanical thrust produced by the pump 108 and isolates the motor 110 from the wellbore fluids in the pump 108. The seal section 112 may also be used to accommodate the expansion and contraction of lubricants within the motor 110 during installation and operation of the pumping system 100.

Although only one of each component is shown, it will be understood that more can be connected when appropriate, that other arrangements of the components are desirable and that these additional configurations are encompassed within the scope of preferred embodiments. For example, in many applications, it is desirable to use tandem-motor combinations, gas separators, multiple seal sections, multiple pumps, sensor modules and other downhole components.

It will be noted that although the pumping system 100 is depicted in a vertical deployment in FIG. 1, the pumping system 100 can also be used in non-vertical applications, including in horizontal and non-vertical wellbores 104. Accordingly, references to "upper" and "lower" within this disclosure are merely used to describe the relative positions of components within the pumping system 100 and should not be construed as an indication that the pumping system 100 must be deployed in a vertical orientation. The use of the terms "upstream" and "downstream" will be understood to refer to relevant positions within the pumping system 100, with the term "upstream" referring to components closer to the pump intake 116 and downstream closer to the wellhead 106.

Figure 2A:
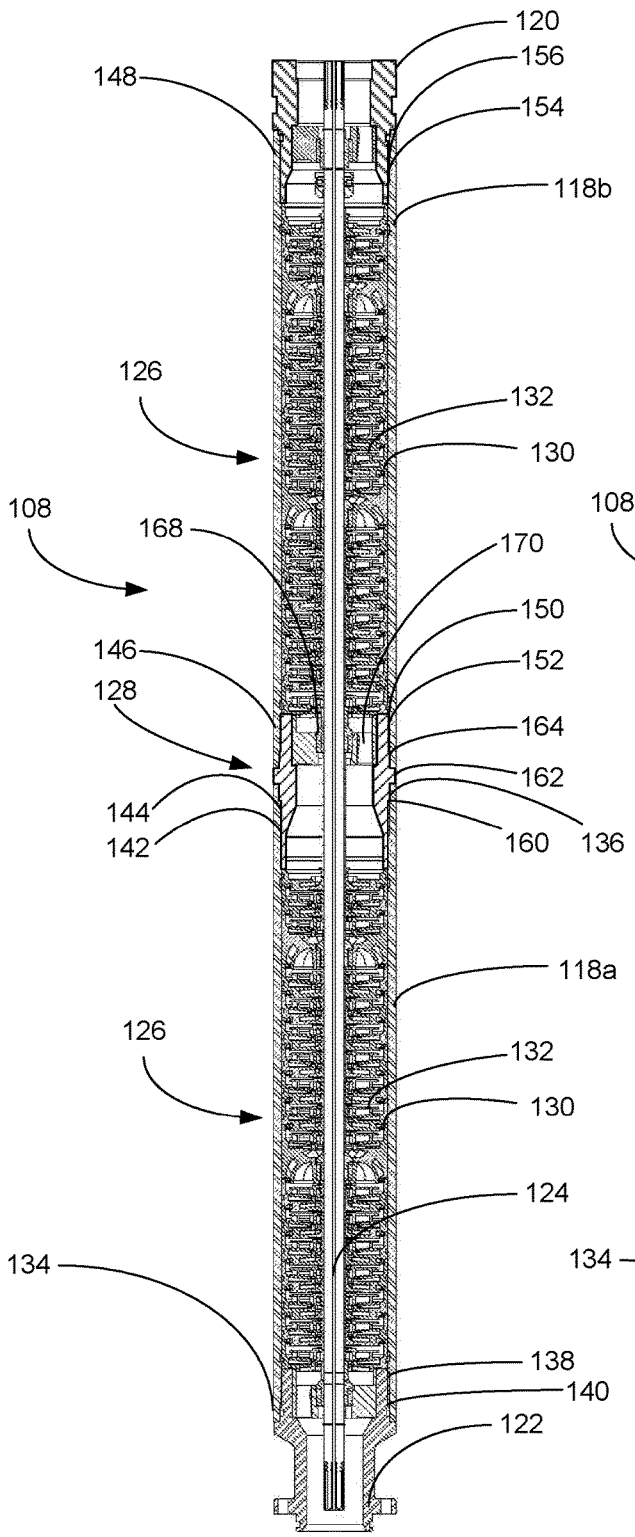
FIGS. 2A and 2B provide a cross-sectional views of a two embodiments of the pump of the pumping system of FIG. 1.
Figure 2B:
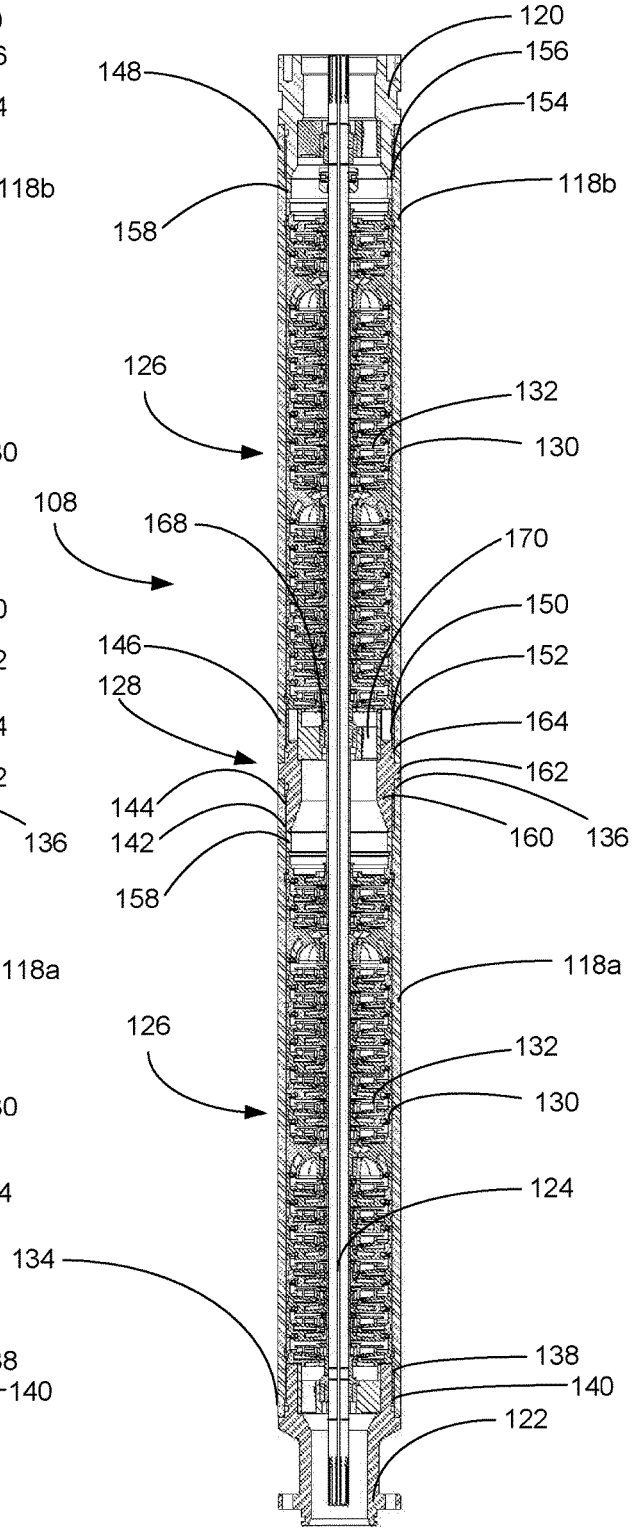

Turning to FIGS. 2A and 2B, shown therein are cross-sectional views of the pump 108. The pump 108 includes a pump housing 118, a head 120, a base 122, a shaft 124, a plurality of stages 126 and one or more compression bulkheads 128. Each of the plurality of stages 126 includes a diffuser 130 and an impeller 132. The impellers 134 are connected to the shaft 124 and configured for rotation within the corresponding diffuser 130. The diffusers are configured to remain stationary within the housing 118.

The housing 118 preferably includes an upstream housing 118*a* and a downstream housing 118*b*. The upstream housing 118*a* includes a first end 134 connected to the base 122 and a second end 136 connected to the compression bulkhead 128. The first end 134 of the upstream housing 118*a* preferably includes internal threads 138 that mate with external threads 140 on the base 122. The second end 136 of the upstream housing 118*a* preferably includes internal threads 142 that mate with external threads 144 on the compression bulkhead 128.

Similarly, the downstream housing 118*b* includes a first end 146 connected to the to the compression bulkhead 128 and a second end 148 connected to the pump head 120. The first end 146 of the downstream housing 118*b* preferably includes internal threads 150 that mate with external threads 152 on the compression bulkhead 128. The second end 148 of the downstream housing 118*b* preferably includes internal threads 154 that mate with external threads 156 on the head 120. In this way, the upstream housing 118*a* is secured between the base 122 and the compression bulkhead 128 and the downstream housing 118*b* is captured between the compression bulkhead 128 and the head 120.

As depicted in FIG. 2B, the pump 108 may optionally include one or more compression sleeves 158 positioned between the head 120 and the adjacent diffuser 130 and between the compression bulkhead 128 and the adjacent upstream diffuser 130. The compression sleeves 158 transfer compressive force applied by the head 120 and compression bulkhead 128 to the diffusers 130. Although only one compression bulkhead 128 is depicted in FIG. 2B, it will be appreciated that the use of additional compression bulkheads 128 is within the scope of preferred embodiments.

Figure 3:
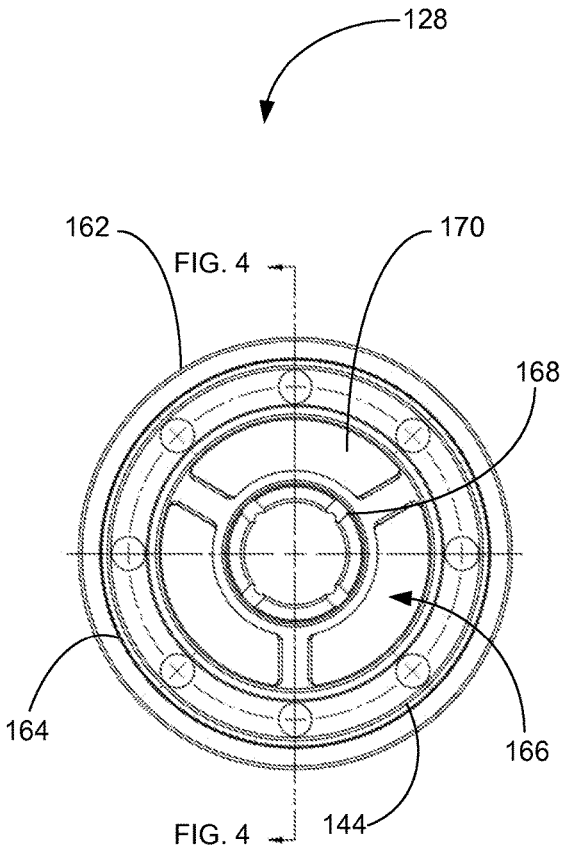
FIG. 3 is a downstream view of a bulkhead of the pump of FIG. 2.
Figure 4:
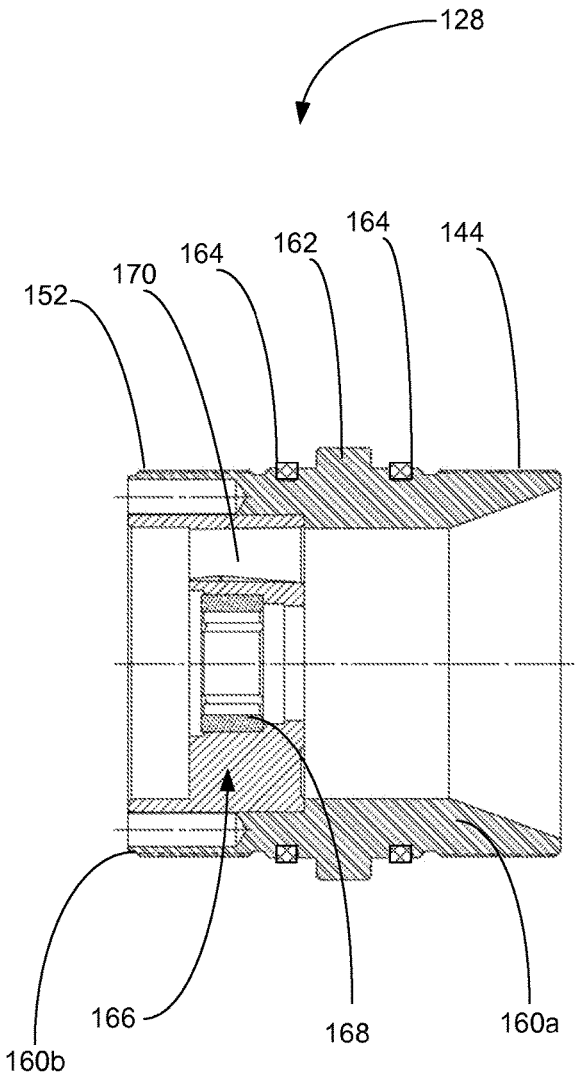
FIG. 4 is a side cross-sectional view of the bulkhead of FIG. 3.

Turning to FIGS. 3 and 4, shown therein are upstream and side cross-sectional views, respectively, of the compression bulkhead 128. The compression bulkhead 128 includes a body 160 that includes an external raised shoulder 162. The body 160 has an upstream portion 160*a* that is adjacent to an upstream stage 126 and a downstream portion 160*b* that is adjacent to a downstream stage 126. The upstream housing 118*a* is configured for threaded engagement with the upstream portion 160*a* of the body and the downstream housing 118*b* is configured for threaded engagement with the downstream portion 160*b*. The extent of engagement between the upstream housing 118*a* and downstream housing 118*b* and the compression bulkhead 128 is limited by the shoulder 162. In a particularly preferred embodiment, the shoulder 162 has an outer diameter that is substantially the same as the outer diameter of the housing 118. The compression bulkhead 128 optionally includes external ring seals 164 that are captured between the compression bulkhead 128 and the upstream housing 118*a* and downstream housing 118*b*.

The compression bulkhead 128 further includes a shaft bearing assembly 166. The shaft bearing assembly 166 provides radial and axial support to the shaft 124. The shaft bearing assembly 166 preferably includes a central bearing 168 and a plurality of outer flow passages 170. The shaft 124 passes through the central bearing 168, while fluid flow passes through the outer flow passages 170.

In a presently preferred method of assembly, the upstream housing 118*a* is threaded onto the base 122. A desired number of stages 126 are then loaded into the upstream housing 118*a*. A compression bulkhead 128 is then threaded into the open end of the upstream housing 118*a*. The compression bulkhead 128 is tightened into the upstream housing 118*a* to a sufficient extent to apply the desired compressive force on the diffusers 130 within the upstream housing 118*a*.

Next, the downstream housing 118*b* is threaded onto the downstream portion of the compression bulkhead 128. A desired number of stages 126 are then loaded into the downstream housing 118*b*. If additional housings 118 are desired, an additional compression bulkhead 128 is used to connect each successive housing 118. If the downstream housing 118*b* is the terminal housing, the head 120 is then threaded into the open end of the downstream housing 118*b*. The head 120 is tightened into the downstream housing 118*b* to a sufficient extent to apply the desired compressive force on the diffusers 130 within the downstream housing 118*b*.

Thus, the compression bulkhead 128 permits a single pump 108 to be divided into two or more sections that each requires a more manageable amount of stage compression. The use of one or more compression bulkheads 128 facilitates assembly and reduces the risk of diffuser rotation during operation of the pump 108.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A multistage centrifugal pump comprising:

an upstream housing, wherein the upstream housing comprises:

a first end;

a second end; and an external diameter;

a plurality of turbomachinery stages within the upstream housing, wherein each of the plurality of turbomachinery stages within the upstream housing includes a diffuser and an impeller;

a downstream housing, wherein the downstream housing comprises;

a first end; and a second end;

a plurality of turbomachinery stages within the downstream housing, wherein each of the plurality of turbomachinery stages within the downstream housing includes a diffuser and an impeller; and a compression bulkhead connected between the second end of the upstream housing and the first end of the downstream housing, wherein the compression bulkhead is in direct contact with the diffusers within the upstream housing and wherein the compression bulkhead comprises a raised shoulder that limits the extent of engagement between the compression bulkhead and both the upstream housing and the downstream housing.

2. The multistage centrifugal pump of claim 1, further comprising a pump head connected to the second end of the downstream housing, wherein the pump head applies a compressive force to the diffusers within the downstream housing.

3. The multistage centrifugal pump of claim 1, wherein the upstream housing and compression bulkhead are configured for threaded engagement.

4. The multistage centrifugal pump of claim 1, wherein the downstream housing and compression bulkhead are configured for threaded engagement.

5. The multistage centrifugal pump of claim 1, wherein the compression bulkhead further comprises:

one or more ring seals between the compression bulkhead and the upstream housing; and one or more ring seals between the compression bulkhead and the downstream housing.

6. The multistage centrifugal pump of claim 1, wherein the compression bulkhead further comprises a shaft bearing assembly, wherein the shaft bearing assembly comprises:

a central bearing; and a plurality of flow through passages.

7. An electric submersible pumping system for use in pumping fluids from a wellbore, the electric submersible pumping system comprising:

a motor; and a multistage centrifugal pump driven by the motor, wherein the multistage centrifugal pump comprises:

a shaft;

an upstream housing, wherein the upstream housing comprises:

a first end;

a second end; and an external diameter;

a plurality of turbomachinery stages within the upstream housing, wherein each of the plurality of turbomachinery stages within the upstream housing includes a diffuser and an impeller;

a downstream housing, wherein the downstream housing comprises:

a first end;

a second end; and an external diameter;

a plurality of turbomachinery stages within the downstream housing, wherein each of the plurality of turbomachinery stages within the downstream housing includes a diffuser and an impeller; and a compression bulkhead connected between the second end of the upstream housing and the first end of the downstream housing, wherein the diffuser within the turbomachinery stage at the first end of the downstream housing is in direct contact with the compression bulkhead and wherein the compression bulkhead comprises a raised shoulder having an external diameter substantially the same as the external diameter of the upstream housing and the external diameter of the downstream housing, and wherein the raised shoulder limits the extent of engagement between the compression bulkhead and both the upstream housing and the downstream housing.

8. The electric submersible pumping system of claim 7, further comprising a pump head connected to the second end of the downstream housing, wherein the pump head applies a compressive force to the diffusers within the downstream housing.

9. The electric submersible pumping system of claim 7, wherein the upstream housing and compression bulkhead are configured for threaded engagement and wherein the downstream housing and compression bulkhead are configured for threaded engagement.

10. The electric submersible pumping system of claim 7, wherein the compression bulkhead further comprises:

one or more ring seals between the compression bulkhead and the upstream housing; and one or more ring seals between the compression bulkhead and the downstream housing.

11. The electric submersible pumping system of claim 7, wherein the compression bulkhead further comprises a shaft bearing assembly, wherein the shaft bearing assembly comprises:

a central bearing that supports the shaft; and a plurality of flow through passages.

12. A method for assembling a multistage centrifugal pump, the method comprising the steps of:

providing an upstream housing that includes a first end and a second end;

providing a downstream housing that includes a first end and a second end;

providing a compression bulkhead that includes an external raised shoulder;

loading a plurality of impellers and diffusers into the upstream housing; and threading a first end of the compression bulkhead into the second end of the upstream housing such that the compression bulkhead is in direct contact with the plurality of diffusers loaded into the upstream housing, wherein the extent of engagement between the upstream housing and the compression bulkhead is limited by contact between the upstream housing and the external raised shoulder of the compression bulkhead;

threading a first end of the downstream housing onto a second end the compression bulkhead, wherein the extent of engagement between the downstream housing and the compression bulkhead is limited by contact between the downstream housing and the external raised shoulder of the compression bulkhead;

loading a plurality of impellers and diffusers into the downstream housing; and threading a pump head into the second end of the downstream housing, wherein the step of threading a pump head into the second end of the downstream housing further comprises engaging the pump head within the downstream housing to an extent sufficient to compress the diffusers within the downstream housing to a desired stage compression.

13. The method of claim 12, further comprising the step of passing a shaft through the impellers in the downstream housing, a shaft bearing assembly in the compression bulkhead and through the impellers in the upstream housing.

14. A method for assembling a multistage centrifugal pump, the method comprising the steps of:

providing a base;

connecting an upstream housing to the base, wherein the upstream housing includes a first end and a second end;

loading a plurality of impellers and diffusers into the upstream housing;

threading a first end of a compression bulkhead into the second end of the upstream housing such that the compression bulkhead applies a compressive force to the plurality of diffusers loaded into the upstream housing;

providing a downstream housing that includes a first end and a second end;

threading a first end of the downstream housing into a second end the compression bulkhead, wherein the downstream housing is separated from the upstream housing by the compression bulkhead;

loading a plurality of impellers and diffusers into the downstream housing;

threading a head into the downstream housing such that the head applies compressive force to the plurality of diffusers loaded into the downstream housing, wherein the plurality of diffusers within the downstream housing are in direct contact with the compression bulkhead; and passing a shaft through the impellers in the downstream housing, a shaft bearing assembly in the compression bulkhead and through the impellers in the upstream housing.

* * * * *